US005428942A

United States Patent [19]

Vandoninck

[11] Patent Number: 5,428,942

[45] Date of Patent: Jul. 4, 1995

[54] METHOD AND DEVICE FOR FILLING A PRESSURE CAPSULE FOR SPRAY CANS, AND A PRESSURE CAPSULE WHICH CAN BE FILLED ACCORDING TO THIS METHOD

[75] Inventor: Alfons Vandoninck, Antwerpen, Belgium

[73] Assignee: Belgium Spray Accessory Factory, Afgekort B.S.A.F. naamloze vennootschap, Opglabeek, Belgium

[21] Appl. No.: 53,385

[22] Filed: Apr. 28, 1993

[30] Foreign Application Priority Data

Apr. 28, 1992 [BE] Belgium ..... 09200383
Jan. 13, 1993 [BE] Belgium ..... 09300027

[51] Int. Cl.[6] ..... B65B 31/00

[52] U.S. Cl. ..... 53/403; 53/470; 141/51; 141/197

[58] Field of Search ..... 53/79, 86, 97, 109, 53/403, 470; 141/46, 51, 65, 197

[56] References Cited

U.S. PATENT DOCUMENTS 4,262,472 4/1981 Soeda et al. ..... 53/403

FOREIGN PATENT DOCUMENTS 0349053 1/1990 European Pat. Off. .

*Primary Examiner*—Linda B. Johnson
*Attorney, Agent, or Firm*—Foley & Lardner

[57] ABSTRACT

Method for filling a pressure capsule for spray cans, in particular for filling a pressure capsule (5) consisting of a reservoir (7) with a discharge opening (8) and a pressure regulator (9) with a valve (10) which works in conjunction with the above-mentioned discharge opening (8), characterized in that the pressure capsule (5) is filled by creating an external pressure difference at the pressure regulator (9), such that the discharge opening (8) is cleared and the reservoir (7) is filled via this opening (8).

18 Claims, 8 Drawing Sheets

4
39
1
6
5
P1
2
3

Fig. 6
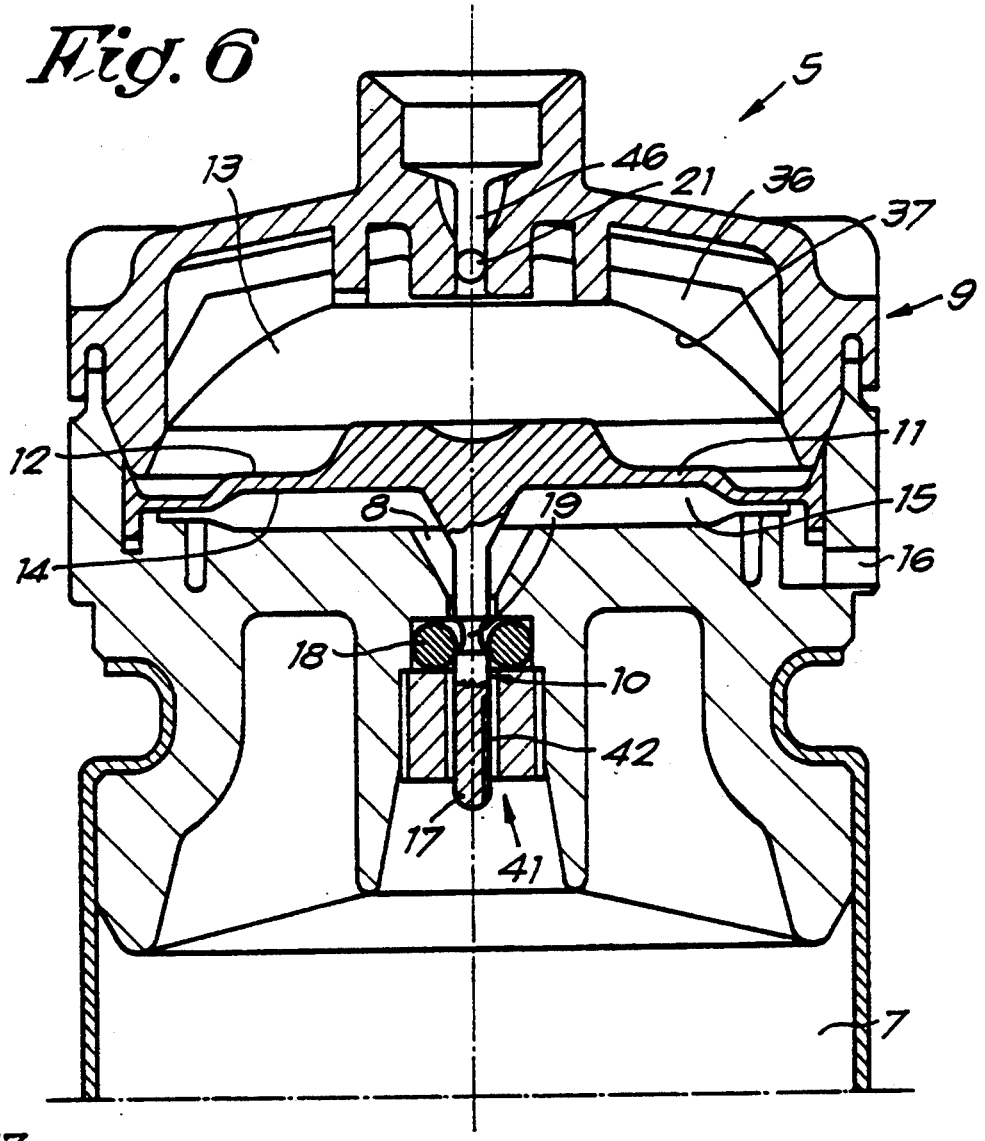
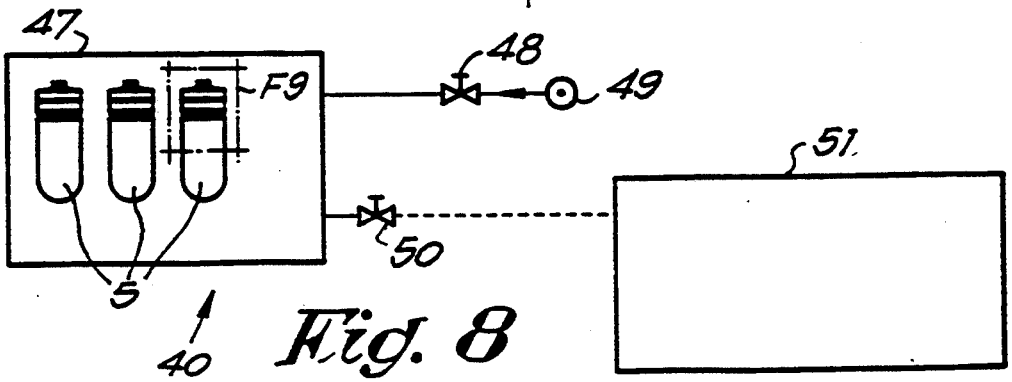
Fig. 8

Fig. 9
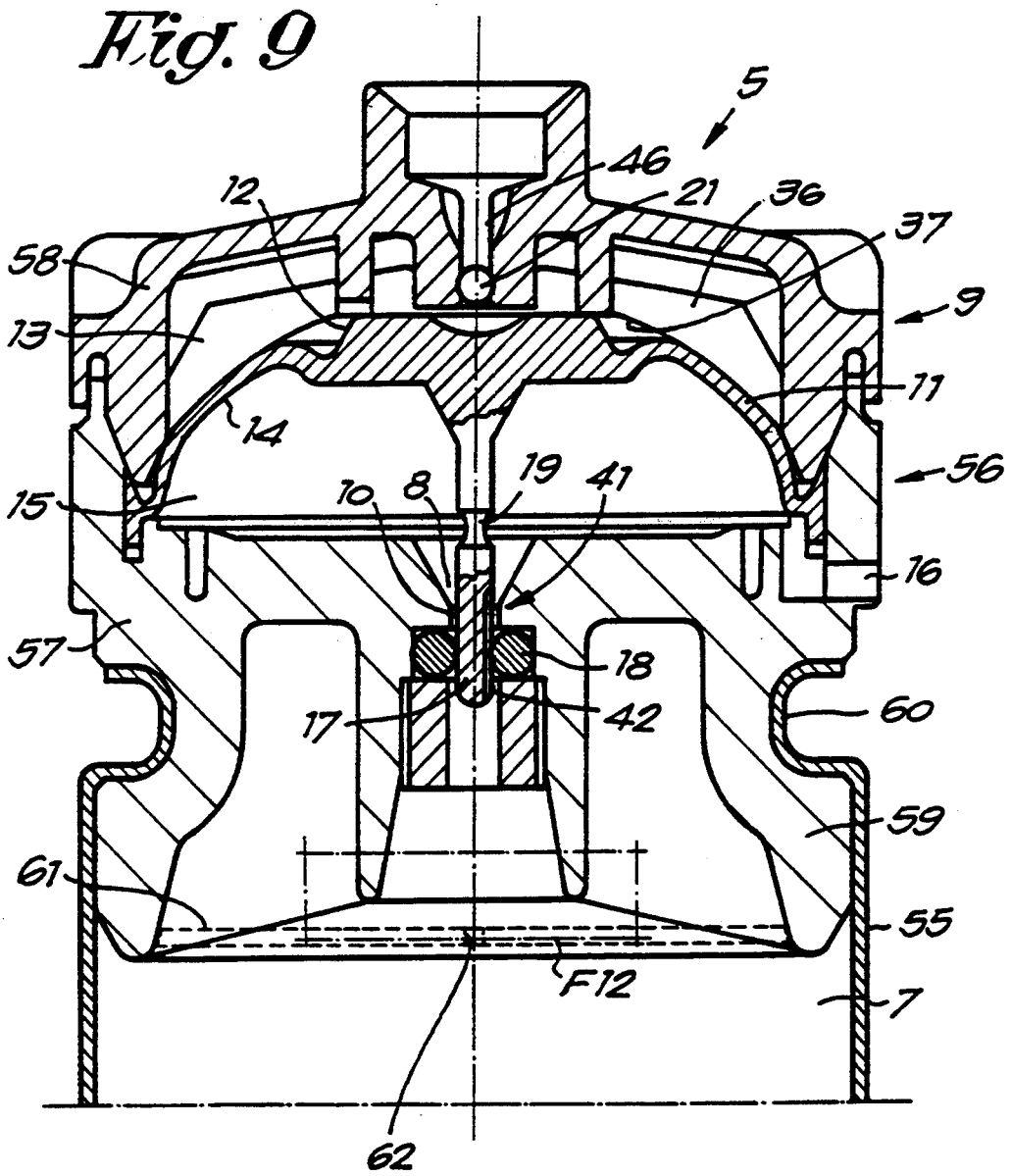
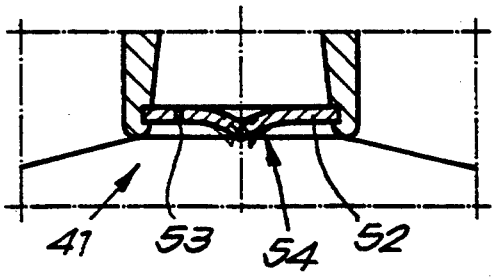
Fig. 12

METHOD AND DEVICE FOR FILLING A PRESSURE CAPSULE FOR SPRAY CANS, AND A PRESSURE CAPSULE WHICH CAN BE FILLED ACCORDING TO THIS METHOD

BACKGROUND OF THE INVENTION

The present invention concerns a method and device for filling a pressure capsule for spray cans, as well as a pressure capsule which can be filled according to this method.

It is known that a pressure capsule can be provided in spray cans, which is equipped with a pressure regulator, such that a constant pressure is maintained in the spray can which suffices to push the useful fluid out when the spray can is used, so as to atomize this for example. The use of a pressure capsule is advantageous in that instead of traditional propellants, such as the harmful chlorine fluorine hydrocarbons, any other gas whatsoever can be used, such as for example air.

The above-mentioned pressure capsules usually consist of a reservoir with a discharge opening and a pressure regulator with a valve which works in conjunction with the above-mentioned discharge opening. The valve is hereby controlled by means of a moveable element, such as a membrane, which is loaded on one side by the pressure in the spray can and which is loaded on the other side by a reference pressure which is created in a room provided to this end.

In order to fill the reservoir of the pressure capsule, this may be provided with a filler opening which is sealed after the reservoir has been filled with a fluid under high pressure. The use of such a filler opening is disadvantageous in that the risk of leaks is increased, in that the pressure capsule is less safe and in that extra operations are required to provide and seal the filler opening.

SUMMARY OF THE INVENTION

The present invention concerns a method and device for filling a pressure capsule which makes it possible to fill the reservoir without a separate filler opening being required in the reservoir.

To this aim the invention concerns a method for filling a pressure capsule for spray cans, .in particular for filling a pressure capsule consisting of a reservoir with a discharge opening and a pressure regulator with a valve which works in conjunction with the above-mentioned discharge opening, characterized in that the pressure capsule is filled by providing an external pressure difference at the pressure regulator, such that the discharge opening is cleared and the reservoir is filled via this opening.

The present invention also concerns a device for realizing the above-mentioned method.

According to a special embodiment, this device is characterized in that it mainly consists of a pressure chamber; first pressure regulating means which make it possible to supply a fluid under pressure to the pressure chamber; second pressure regulating means which make it possible to supply a fluid under pressure to the room in the pressure capsule where the reference pressure is built up; and control means which sequentially switch on and off the first and second pressure regulating means and also control them according to a specific control pattern.

According to another possibility, the invention provides a device which is characterized in that it mainly consists of a pressure chamber; means to put the pressure chamber under pressure and means which make it possible to create a sudden pressure drop in the pressure chamber.

The present invention also concerns a pressure capsule which can be filled according to the above-mentioned method, consisting of a reservoir with a discharge opening and a pressure regulator with a valve which works in conjunction with the above-mentioned discharge opening, characterized in that the pressure regulator is designed such that the valve can be opened by providing an external pressure.

BRIEF DESCRIPTION OF THE DRAWINGS

In order to better explain the characteristics according to the invention, by way of example only and without being limitative in any way, the following preferred embodiment is described with reference to the accompanying drawings, in which:

FIG. 6 shows yet another part of a pressure capsule according to the invention;

FIG. 8 shows a device for filling pressure capsules of the type as represented in FIGS. 6 and 7;

FIG. 9 shows the part which is indicated in FIG. 8 by F9 to a larger scale and as a section;

FIG. 12 represents a part which can be provided in the place which is indicated in FIG. 9 by F12 for yet another embodiment of the pressure capsule.

DESCRIPTION OF THE PREFERRED EMBODIMENTS

Figure 1:
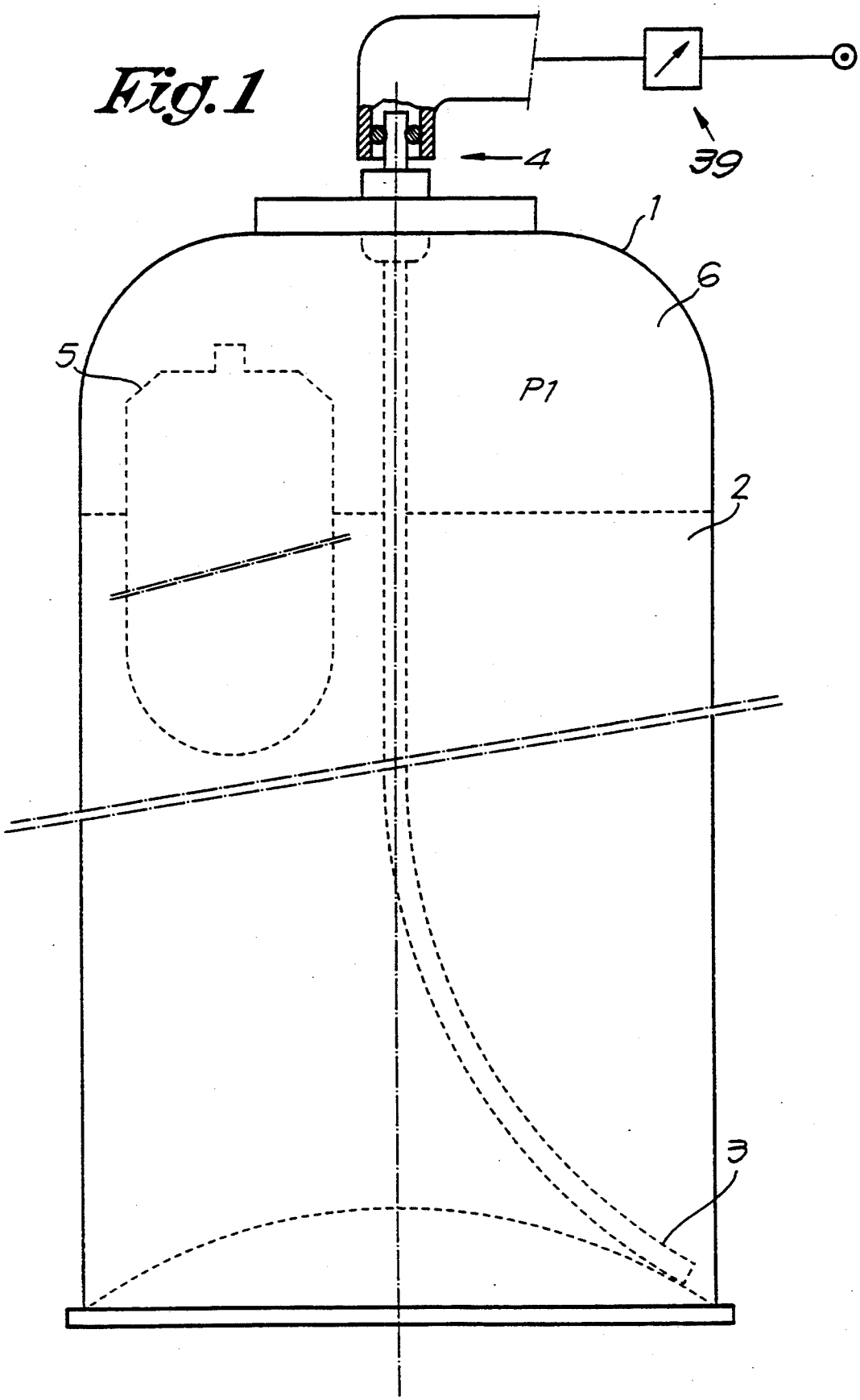
FIG. 1 shows a spray can which is equipped with a pressure capsule according to the invention.

As shown in FIG. 1, a spray can 1, in order to push out the fluid 2 contained therein via the riser 3 as the push button 4 or such like is excited, can be equipped with a pressure capsule 5 which maintains a specific pressure in the room 6 of the spray can 2.

Figure 2:
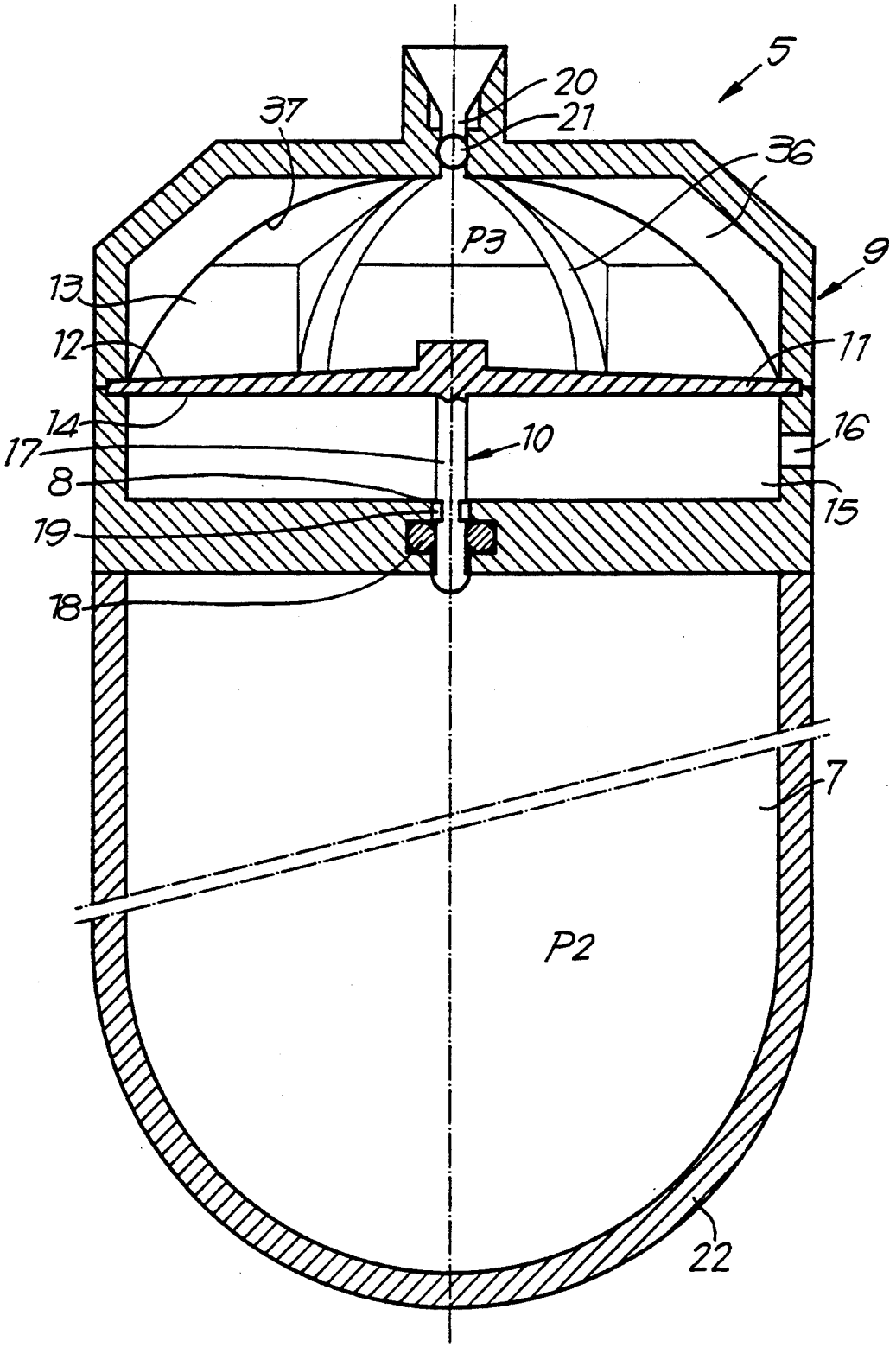
FIG. 2 shows a section of the pressure capsule of the spray can in FIG. 1.

As shown in FIG. 2, this pressure capsule 5 may consist of, on the one hand, a reservoir 7 which is designed to be filled with a fluid under extremely high pressure and which is provided with a discharge opening 8, and on the other hand, a pressure regulator 9 with a valve 10 which works in conjunction with the above-mentioned discharge opening 8. The pressure regulator 9 mainly consists of a moveable element 11, such as a membrane, which controls the valve 10, and one side 12 of which works in conjunction with a room 13 in which a reference pressure can be built up, whereas the other side 14 is loaded by the pressure prevailing in the surroundings of the pressure capsule 5, for example because this side 14 borders a room 15 which is connected to the surroundings via an opening 16.

In the example shown in FIG. 2 the valve 10 consists of a valve stem 17 which is made as one piece with the moveable element 11, in this case the membrane, whereby this valve stem 17 reaches through the discharge opening 8 and works in conjunction with a sealing member 18 provided in this opening 8. A recess 19 is provided in the valve stem 17 which makes it possible for fluid to escape from the reservoir 7 in one particular position of the valve stem 17, whereas as this position shifts, in one direction or the other, the sealing of the discharge opening 8 is provided for.

The above-mentioned room 13 can be filled with a fluid under pressure via a fill opening 20 in which a stopping element 21, such as a ball, can be provided.

When used in the spray can 1, the valve stem 17 assumes a position as represented in FIG. 2. The pressure P1 in the spray can is set by the pressure regulator 9 at a specific value which suffices to drive the fluid 2 out of the room 6. The pressure P1 is usually 5.5 bar. The pressure P2 in the reservoir 7 is for example 50 bar, whereas the reference pressure P3 is 5 to 5.5 bar.

It is clear that as the fluid 2 is atomized, the pressure P1 drops, as a result of which the membrane 11 bends through in the downward direction and the recess 19 is situated at the height of the sealing member 18. Hereby, gas can escape from the reservoir 7 via the recess 19, as a result of which the pressure P1 rises again until the balance is recovered.

The invention is special in that it provides for a method and device, as well as for a pressure capsule which can be filled according to the above-mentioned working method, one and other such that the reservoir 7 of the pressure capsule 5 can be filled with a fluid under extremely high pressure without a special filler opening being required to this end in the wall 22 of the reservoir 7.

The method according to the invention consists in that the pressure capsule is filled because an external pressure difference is created at the pressure regulator, such that the above-mentioned discharge opening 8 is cleared, after which the reservoir 7 is filled via this opening.

Figure 3:
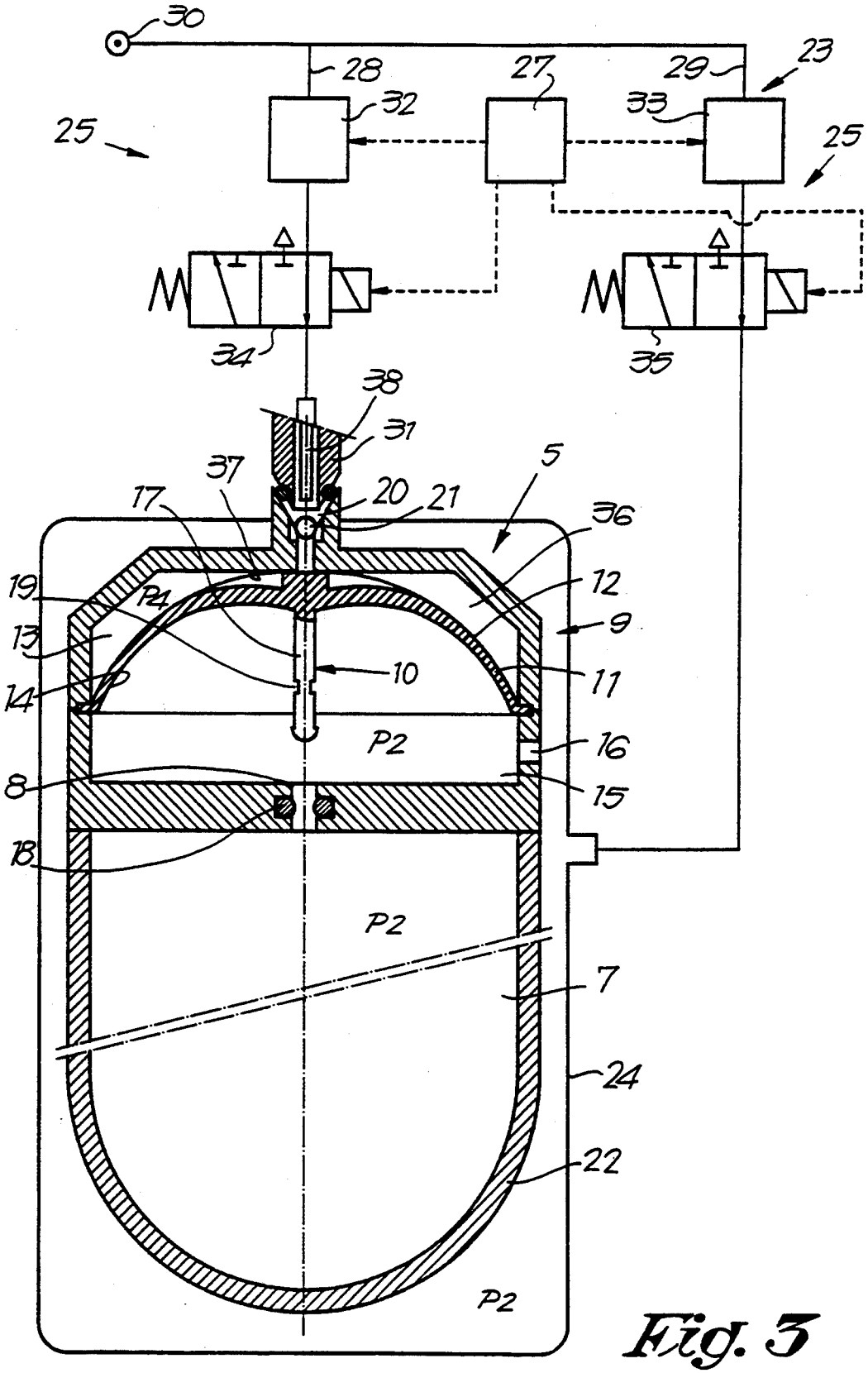
FIGS. 3 to 5 elucidate the method according to the invention for filling the pressure capsule in FIG. 2 step by step.

As shown in FIGS. 2 and 3, the pressure capsule 5 according to the invention is hereby designed such that the valve 10, when an external pressure difference is created at the pressure regulator 9, provides for a free passage through the discharge opening 8.

In the example from FIGS. 2 to 5, the pressure capsule 5 is made such to this end that the valve 10, and more in particular the valve stem 17, can be entirely lifted from the discharge opening 8 as the moveable element 11 is moved, more in particular as represented in FIG. 3.

Figure 4:
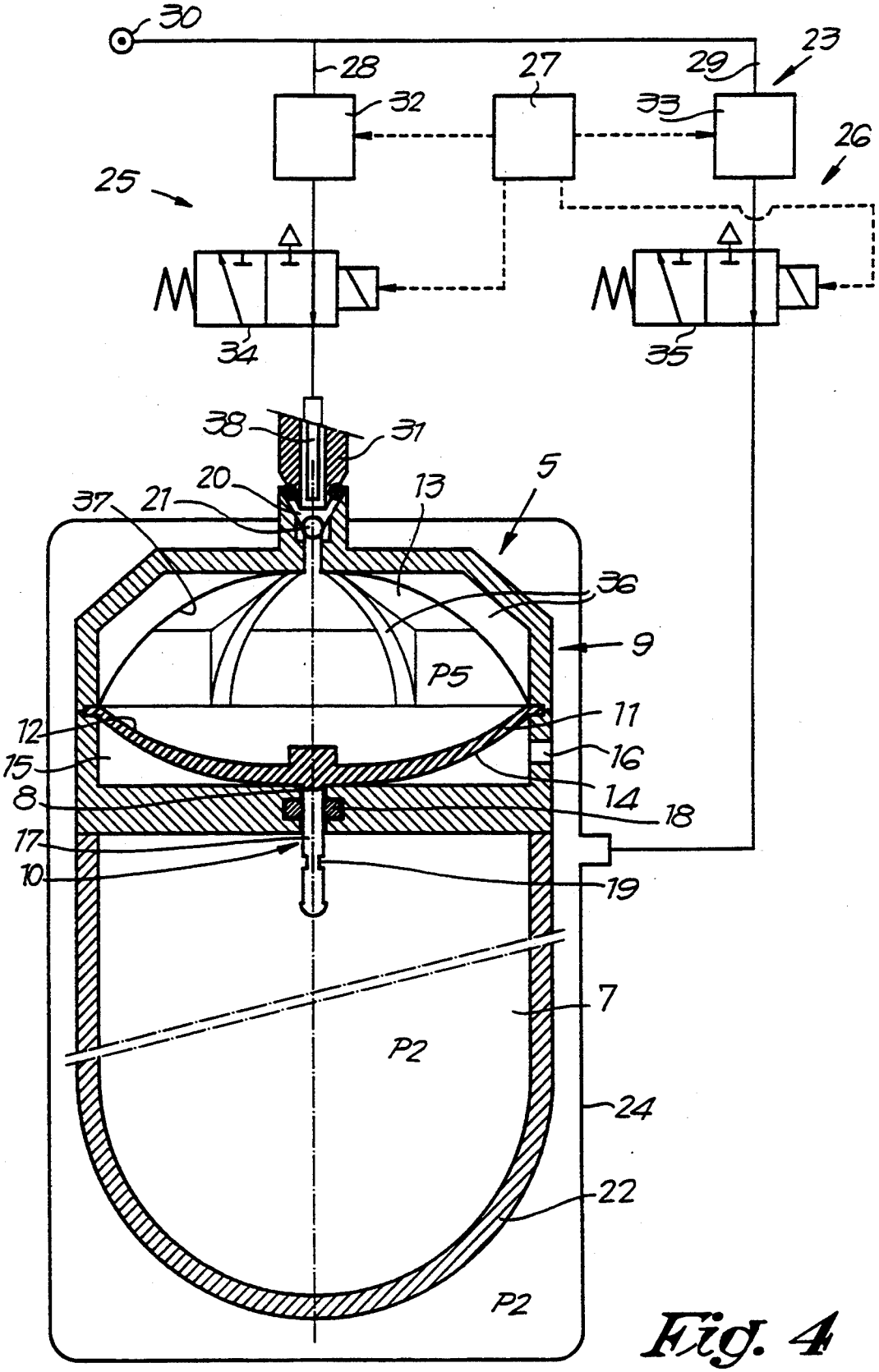
Figure 5:
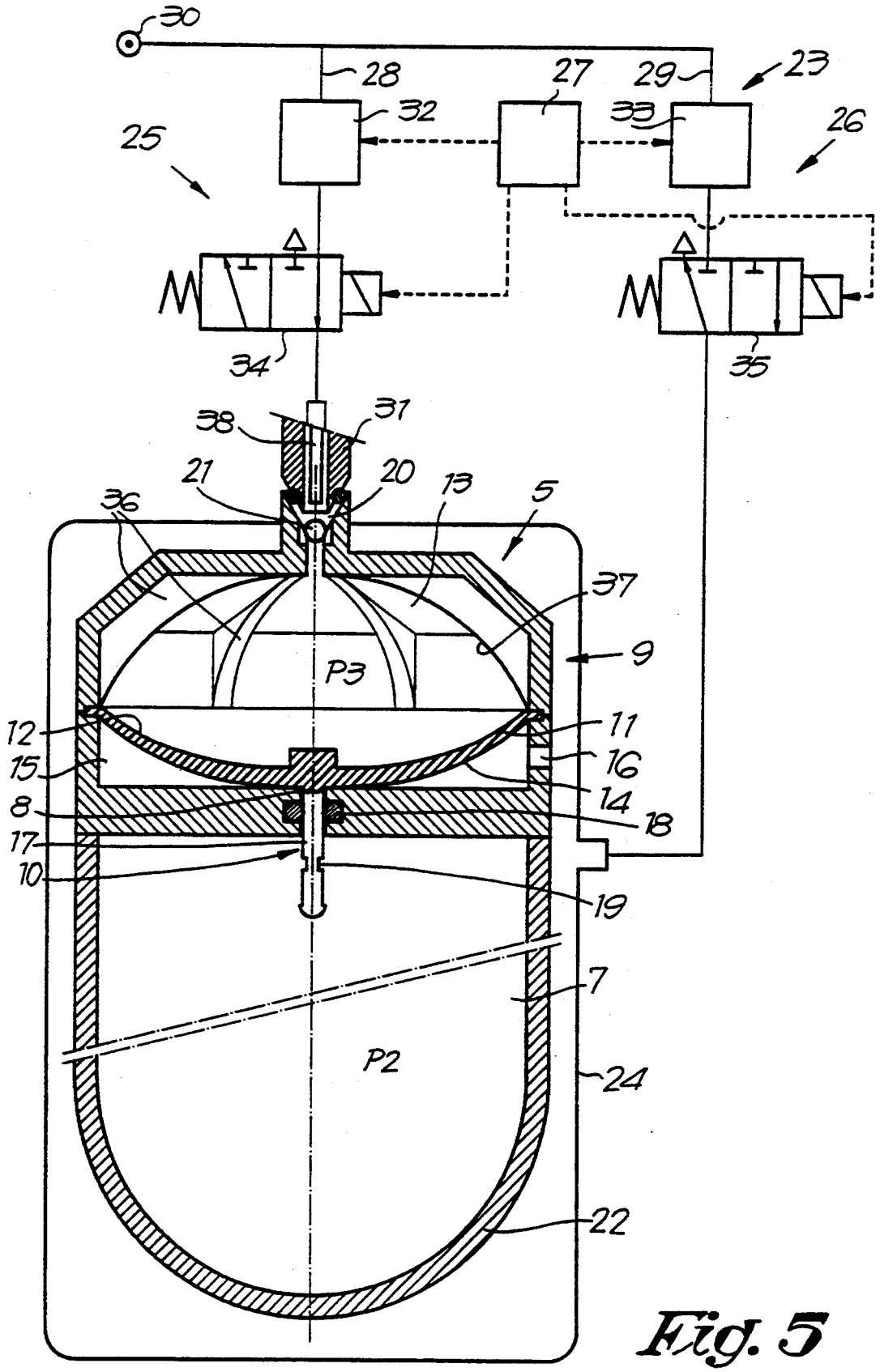

The different steps which can be followed for the filling, and an embodiment of a device 23 to realize these steps, are described hereafter in detail by means of FIGS. 3 to 5.

The device 23 mainly consists of a pressure chamber 24; first pressure regulating means 25 which make it possible to supply a fluid under pressure to the pressure chamber 24; second pressure regulating means 26 which make it possible to supply a fluid under pressure to the room 13 of the pressure capsule 5 where the reference pressure is built up; and control means 27 which sequentially switch on and off the first and second pressure regulating means, and also control them according to a specific control pattern.

The first and second pressure regulating means 25 and 26 preferably consist of pipes 28 and 29 going from a compressed air source 30 to a filling mouth 31 which can work in conjunction with the filler opening 20 and to the pressure chamber 24 respectively, and a pressure regulator 32-33 and a valve 34-35 in each pipe 28-29. The pressure regulators 32 and 33 make it possible to set different pressures, whereas the valves 34 and 35 make it possible to supply the fluid to the filler mouth 31 and the pressure chamber 24, or provide for a de-aeration.

According to the invention, the pressure capsule 5 is filled by opening the valve 35, as a result of which the pressure chamber 24 is put under pressure. The pressure regulator 33 is hereby set such that at least a pressure P2 is provided in the pressure chamber 24 which is equal to, or possibly higher than the pressure with which the reservoir 7 should be provided. This leads to a situation as represented in FIG. 3, whereby the moveable element 11 is moved such, or in this case the membrane is bent such that the valve stem 17 protrudes from the discharge opening 8 and the fluid supplied via the pipe 29 can reach the reservoir 7.

The above-mentioned room 13 can be de-aerated, but preferably a counter pressure P4 is built up here, this in order to prevent the membrane 11 from being damaged, for example from being torn. Said counter pressure P4 preferably amounts to at least 50% of the pressure P2, and is for example 30 bar in the above-described application.

The counter pressure P4 is supplied via the pipe 28 and the valve 34, whereby the pressure regulator 32 provides for the required pressure.

In order to prevent the membrane or such like from being damaged, supporting means can be mounted in the room 13 of the pressure capsule 5, such that the membrane will bend through homogeneously. These supporting means consist for example of ribs 36 with a bent edge 37.

In a subsequent stage, the valve 8 is closed again. To this end the valve stem 17 is pushed through the discharge opening 8 as far as possible. As represented in FIG. 4, this can be realized by creating a pressure P5 in the room 13 which is higher than the pressure P2, for example 75 bar, by changing the setting of the pressure regulator 32.

In order to prepare the pressure capsule 5 for being removed from the pressure chamber 24, ready for use, as shown in FIG. 5, the pressure chamber 24 is de-aerated by moving the valve 35 and by creating the required reference pressure P3 in the room 13. The pressure P3 can be obtained by means of a correct setting of the pressure regulator 32.

The reference pressure P3 is not created until the valve 8 is closed.

After the reference pressure P3 has been created, the room 13 is closed off from the surroundings by pressing the stopping element 21 in the filler opening, for example by means of a pin 38.

The de-aeration via the pipe 29 and the valve 35 is either carried out simultaneously with the removal of the high pressure P5, or before the removal of said pressure.

After this, the pressure capsule 5 is ready for use. This implies that it can be removed from the pressure chamber 24 and that it can be stored until it is built in in a spray can 1.

In order to activate the pressure capsule 5, as shown in FIG. 1, an external pressure is created at the spray can 1 which is equal to or slightly higher than the normal operating pressure P1, as a result of which the valve 8 assumes a position as represented in FIG. 2, such that the automatic pressure regulation starts working.

Said pressure is provided by means of pressure regulating means 39.

According to a special embodiment, the invention also concerns a method which is characterized in that measures are taken to restrict the flow-out from the reservoir 7 in the opened position of the valve 10 and in that, in order to close the valve 10 after the filling of the reservoir, an external decompression, in other words expansion, is provided, whereby, the speed and the pressure drop of the decompression on the one hand and the restriction of the flow-out on the other hand are adjusted such to one another that the valve 10, through the agency of the pressure regulator 9 and as a result of the decompression, provides for the sealing of the discharge opening 8. This method is advantageous in that only one operation is needed to fill the reservoir 7, whereby the pressure capsule 5 only needs to be placed in a room where a pressure P2 as mentioned above or a slightly higher pressure prevails. This method, an embodiment of the pressure capsule 5 used hereby and a device 40 to realize the method, are described hereafter by means of FIGS. 6 to 11.

The pressure capsule used hereby is represented in FIG. 6 under operating conditions. The pressure capsule of FIG. 6 is special, as opposed to that of FIG. 2, in that it has means 41 which restrict the flowing out of fluid from the reservoir 7.

Preferably, these means 41 consist of a restriction which at all times limits the delivery of the fluid coming out of the reservoir 7. As shown in FIG. 6, this restriction may consist of a recess 42 in the valve 10. In the case where said valve 10, as represented, consists of a valve stem 17 which fits through a sealing member 18, the restriction preferably consists of a recess provided in the valve stem 17, for example a groove stretching from the free end over a certain distance in the longitudinal direction.

Figure 7:
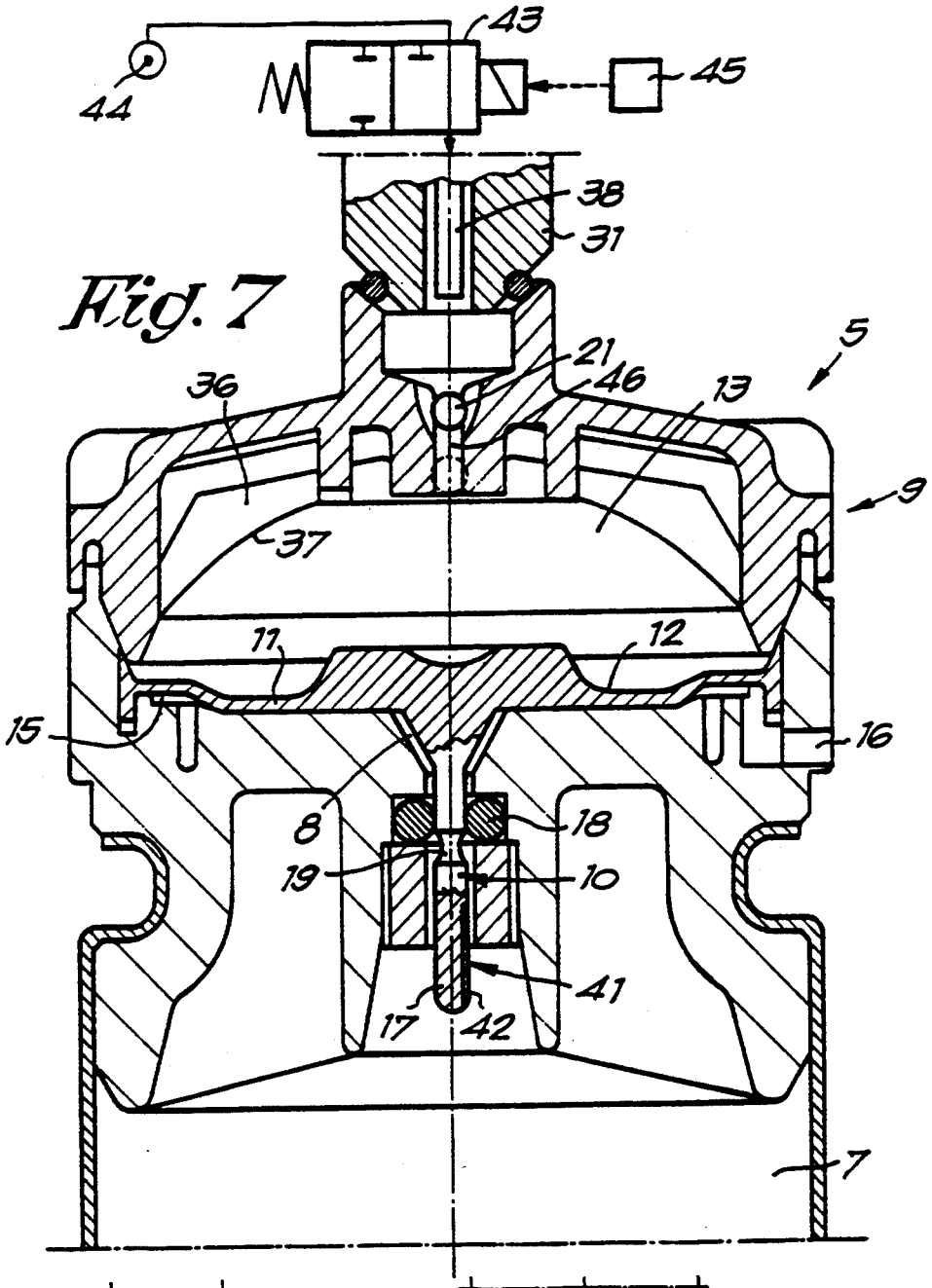
FIG. 7 shows a view of the part in FIG. 6 as the pressure is being built up in the room which provides for the reference pressure.

When the pressure capsule 5 from FIG. 6 is filled, this should preferably be done as follows. First, fluid is supplied under pressure in the room 13, whereby said pressure may act as counter pressure for the moveable element 11, whereby this pressure may be selected such in this case that the room 13 can already be sealed and the amount of fluid which is available here is sufficient to provide for the required reference pressure P3 later on. As represented in FIG. 7, the room 13 can be filled with a fluid under pressure by means of a filler mouth 31 which is connected to a compressed air source 44 via a valve 43. The valve 43 can hereby be controlled by means of a control 45. The sealing is for example provided for by means of a stopping element 21 which can be pushed in the filler opening 46 concerned by means of a pin 38.

The filling of the room 13 with a required amount of fluid can already be done at the time of the production of the pressure capsule 5.

In order to fill the reservoir 7 with a fluid under high pressure, namely said pressure P2, it is sufficient to place the pressure capsule as a whole in a pressure chamber 47 which, as represented in FIG. 8, is put under pressure via the required means, such as a valve 48 and a compressed air source 49. As a result, the moveable element 11, in this case the membrane, assumes a position as represented in FIG. 9, one and other such that the recess 42 comes at the height of the sealing member 18, such that a free connection is created between the reservoir 7 and the immediate surroundings of the pressure capsule 5, whereby this connection is characterized, however, by a narrow passage.

It is clear that in this position, fluid pours from the pressure chamber 47 in the reservoir 7, namely via the opening 16, the room 15 and the recess 42, until a balance is created between the pressure in the reservoir 7 and the pressure in the pressure chamber 47. Although the recess 42 confines the inlet zone, it is clear that the filling will be done quite rapidly. In practice, this only requires a few seconds.

From the above it is clear, as well as from FIG. 9, that the lengths of the recess 42 and of the valve stem 17 are chosen such that the recess 42, in the position represented in FIG. 9, is exactly at the height of the sealing member 18. In this position, the membrane of the pressure regulator 9 will normally be pressed against the special supports provided to this end such as ribs 36, although this is not necessarily always the case.

By subsequently providing for a rapid decompression in the pressure chamber 47, the valve 10 reassumes a position as represented in FIG. 7. For a rapid decompression has for a result that the room 15 is practically immediately de-aerated via the relatively large opening 16, and the moveable element 11, due to the pressure in room 13, is moved downward. The small dimensions of the recess 42 prevent that a large amount of fluid flows back all at once from the reservoir 7, such that a counter pressure cannot possibly be built up quickly in the room 15, which would push the moveable element 11 up again.

The sudden decompression can be obtained by connecting the pressure chamber 47 via a valve 50 with a relatively large opening, such as a cock, with the atmospheric surroundings. It is clear that also other means can be used to this end.

Figure 10:
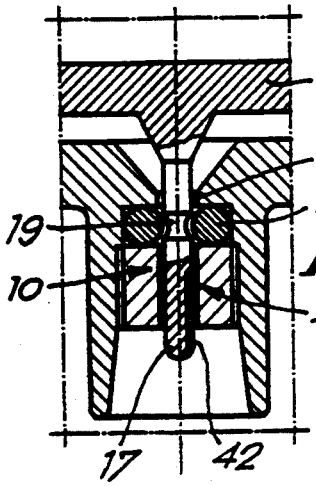
FIGS. 10 and 11 represent the valve of the pressure capsule in FIG. 9, in yet two other positions.

It should be noted that as the element 11 is moved from the position in FIG. 9 to the bottommost position, the recess 19 is briefly situated at the height of the sealing member 18, as represented in FIG. 10. A free passage is then created between the sealing member 18 and the valve stem 17. This passage is also narrow, whereby the flow-back of fluid is restricted to a very small delivery, such that when the valve stem 17 is in the position from FIG. 10, a sudden pressure built-up under the element 11 is excluded.

After this, the pressure capsule 5 is ready for use, and can be activated in the way as represented in FIG. 1.

According to a variant, which is represented in FIG. 8, the decompression can be done gradually, whereby at first there is an expansion to for example 8 bar, and the expanded fluid as represented in FIG. 8 is caught in a tank 51, after which the pressure which is available here can be used to drive certain elements, which are whether or not related to the invention, pneumatically or to provide assistance for their drive. Subsequently, the room 47 is further de-aerated.

Figure 11:
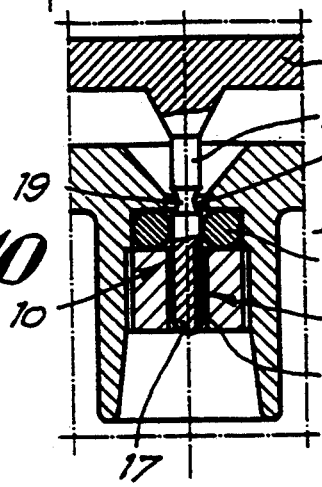

Between said two stages, the valve 10 assumes for example a position as represented in FIG. 11.

It is clear that the method of FIGS. 6 to 11 is considerably less complicated than that of FIGS. 2 to 5. An advantage hereby consists in that the reservoirs 7 of several pressure capsules 5 can all be simultaneously filled by placing large quantities of them in a pressure chamber 47 and in that-the room 13 can be filled and sealed in advance.

FIG. 12 shows yet another detail of a variant. The part represented in FIG. 12 can be provided in the place which is indicated in FIG. 9 by F12 and makes it possible to use a valve 10 as represented in FIG. 3, in other words a valve 10 which can move entirely out of the opening 8. This is particular in that the above-mentioned means 41 are no longer provided at the height of the valve 10, but consist of a wall 52 provided in the outlet of the reservoir 7 and an opening 53 with a small section provided herein. The wall 52 may contain a non-return valve 54 through which fluid may flow in the reservoir 7, but cannot flow back through it, such that it must flow back via the opening 53. The non-return valve 54 allows for a fast filling.

The opening 53 has the same function as the recess 42.

It is clear that for the realization of the above-mentioned methods, the pressures P1–P5 may also have other values. However, the pressure P2 is preferably 30 to 100 bar.

It is also clear that the invention can also be used for other forms of pressure regulators, for example whereby the moveable element 11 consists of a disc which can be moved as a piston, or for example whereby the pressure regulator makes use of elastic means such as springs. Thus, the reference pressure can, for example, be partly or entirely created in the room 13 by means of a spring.

As shown in FIG. 9, the reservoir 7 preferably consists of a metal holder 55, which is sealed by means of a head 56 in which the pressure regulator 9 is built in. The head 56 is preferably made of synthetic material and consists of two parts attached to one another 57 and 58. The head 56 and the metal holder 55 are preferably attached to one another by means of cooperating parts 59 and 60 which for example fit in one another, such as collars. To this end, the free edge of the holder 55 can be rolled tight in a recess in the part 59. In order to prevent that the part 59, which is made of synthetic material, is bent inward, for example due to heat, under the influence of chemicals, due to a manufacturing error or due to the combination of various factors, and in order to prevent the head 56 or part thereof from being shot off like a projectile due to the high pressure in the reservoir 7, a reinforcement may be provided in the part 59 in the shape of a plate 61 made of metal or such like which is provided with a small opening 62, which also serves as a restriction.

The present invention is in no way limited to the embodiments described by way of example and shown in the accompanying drawings; on the contrary, such a method and device for filling a pressure capsule in spray cans, as well as the pressure capsule, can be made in various forms and dimensions while still remaining within the scope of the invention as described in the following claims.

I claim:

1. A method of filling a pressure capsule for spray cans, comprising:

providing the pressure capsule with a reservoir having a discharge opening communicating with a pressure regulator, the pressure regulator including two chambers and a valve for opening and closing the discharge opening;

opening the discharge opening by creating a pressure difference in the two chambers by injecting an external filling fluid into one of the two chambers; and filling the reservoir of the pressure capsule through the discharge opening with the filling fluid and closing the reservoir.

2. The method of claim 1, including:

placing a movable element between the two chambers and connecting the valve to the movable element;

creating a reference pressure on one side of the movable element; and creating a counter pressure on the one side of the movable element that is greater than the reference pressure and lower than a pressure of the external filling fluid.

3. The method of claim 2 including:

providing the counter pressure with a pressure value of at least half a pressure value of the external filling fluid.

4. The method of claim 1, including:

placing a movable element between the two chambers and connecting the valve to the movable element;

creating a reference pressure on one side of the movable element;

creating a high pressure, which is greater than the pressure of the filling fluid, on the one side of the movable element after the filling fluid has filled the reservoir; and closing the discharge opening with the valve.

5. The method of claim 4 including:

creating a pressure equal to the reference pressure on the one side of the movable element after the valve has closed the discharge opening; and closing off the one of the two chambers on the one side of the movable element.

6. The method of claim 5, including:

removing the pressure of the filling fluid from the pressure capsule before or simultaneously with removing the high pressure from the one side of the movable element.

7. The method of claim 1, including:

restricting a flow of fluid from the reservoir to one of the two chambers when the discharge opening is open; and providing an external decompression with a speed and pressure drop adjusted to seal the discharge opening with the valve by agency of the pressure regulator.

8. The method of claim 7, including:

filling the reservoir with the filling fluid by providing a single external pressure.

9. The method of claim 8, including:

filling the reservoir in a pressure chamber; and providing the pressure chamber with a pressure releasing the pressure in the pressure chamber by a cock.

10. The method of claim 7, including:

placing a movable element between two chambers and connecting the valve to the movable element;

creating a reference pressure on one side of the movable element; and creating a counter pressure on the one side of the movable element.

11. The method of claim 10, including:

providing a predetermined amount of filling fluid to the one of the two chambers in which the counter pressure is provided to allow the reference pressure to be available when the pressure capsule is used; and closing off the one of the two chambers in which the counter pressure is provided during filling of the reservoir.

12. The method of claim 7, including:

limiting the flow-back of fluid from the reservoir with a built-in restriction.

13. The method of claim 1, including:

providing the valve with a valve stem having a recess;

configuring the valve stem to work in conjunction with a sealing member in the discharge opening; and forming an obstruction of passageway in the discharge opening by moving the valve stem to different operative positions.

14. The method of claim 1, including:

filling the reservoir with the filling fluid until a pressure created by said filling fluid reaches 30 to 100 bar.

15. The method of claim 2, including:

placing the pressure capsule in a pressure chamber;

supplying a fluid under pressure via a first pressure regulating means to create the reference pressure;

supplying the pressure chamber with the filling fluid under pressure via a second pressure regulating means; and controlling the first pressure regulating means and second pressure regulating means with a control means.

16. The method of claim 15, including:

placing the pressure chamber under pressure; and allowing a sudden drop in pressure to occur in the pressure chamber.

17. The method of claim 1, wherein:

the filling fluid is a gas.

18. The method of claim 1, wherein the filling fluid is a liquid.

* * * * *